United States Patent [19]

Upton et al.

[11] 3,948,396

[45] Apr. 6, 1976

[54] DEVICE FOR HOLDING SPOOLS OF THREAD

[75] Inventors: Everett Upton; Wrietha Upton, both of Exeter, Calif.

[73] Assignee: The Raymond Lee Organization, Inc., a part interest

[22] Filed: Oct. 25, 1974

[21] Appl. No.: 517,872

[52] U.S. Cl. ..... 211/59; 223/106

[51] Int. Cl.[2] ..... A47B 81/00

[58] Field of Search ..... 211/13, 57, 59, 125, 162; 242/134, 139; 223/106, 107; 108/92; 28/29, 55.5

[56] References Cited

UNITED STATES PATENTS

| | | | |
|---|---|---|---|
| 510,509 | 12/1893 | Idol | 223/107 X |
| 1,622,107 | 3/1927 | Harrod | 211/59 |
| 2,399,337 | 4/1946 | Fast | 211/125 X |
| 2,858,089 | 10/1958 | Yasui | 242/134 |
| 3,506,215 | 4/1970 | Krikorian | 242/134 |

*Primary Examiner*—Roy D. Frazier
*Assistant Examiner*—Robert W. Gibson, Jr.

[57] ABSTRACT

A plurality of vertically elongated posts are disposed in elongated tiers on a horizontal base. The posts may be moved upwardly or downwardly through holes in the base. Means allow each of the posts to be independently raised upwardly from the base and to be subsequently lowered to the original position. The posts serve as axles upon which spools can be placed, and about which the spools can rotate while dispensing or winding up thread and the like.

2 Claims, 4 Drawing Figures

DEVICE FOR HOLDING SPOOLS OF THREAD

SUMMARY OF THE INVENTION

The invention is directed towards a device that will conveniently store spools of thread in neatly ordered rows, and will provide a convenient means for selectively locating any spool or combination of spools from the rest of the collection.

Thus a horizontal base bears a plurality of vertical posts being arranged in elongated rows. Manually operable means cooperating with the base and the posts allows each of the posts to be independently raised upwardly from a normal position of minimum height above the base and to be independently lowered thereafter to the normal position.

Spools are placed on the posts, with no more than one spool per post. Each post serves as an axle about which a spool may rotate. To select a spool which is to be quickly identified from the rest of the spools in the collection, its supporting post with the spool thereon is raised in its row.

DETAILED DESCRIPTION OF PREFERRED EMBODIMENTS

Figure 1:
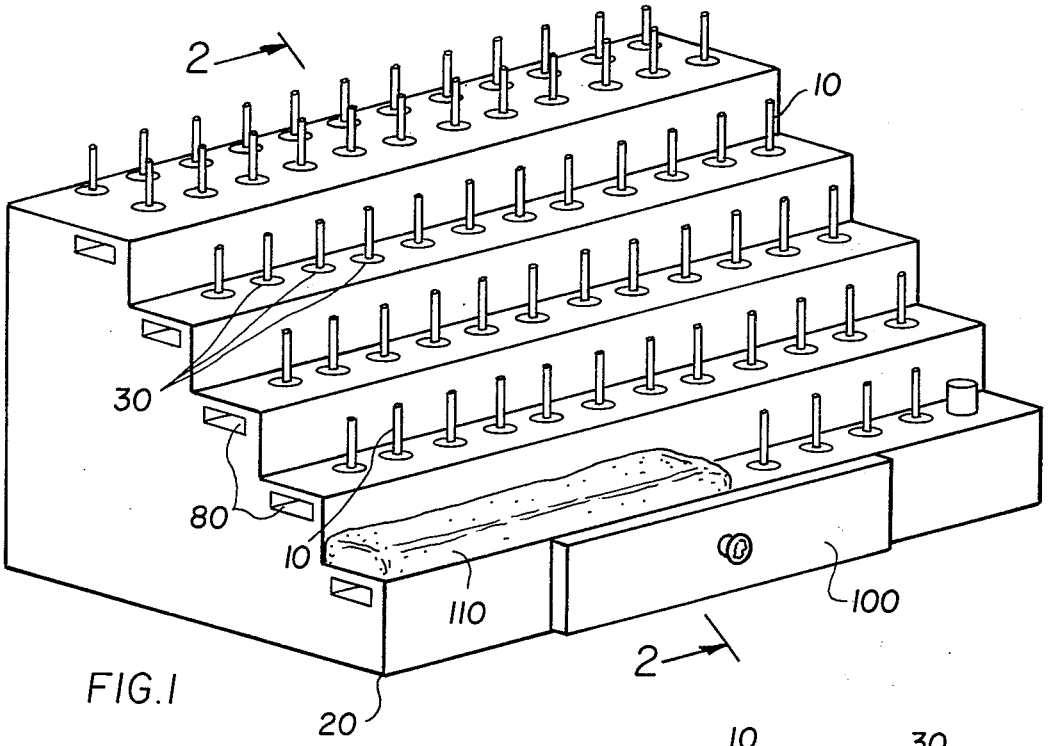
FIG. 1 is a drawing of the invention.
Figure 3:
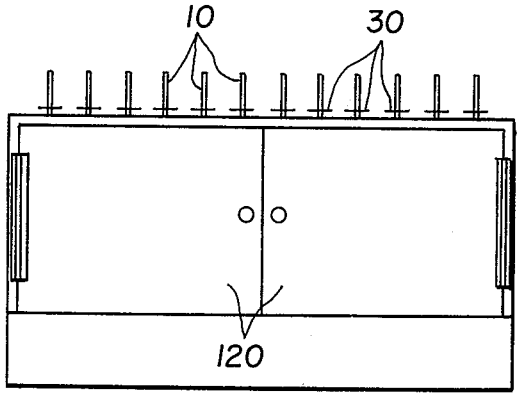
FIG. 3 is a rear view of the invention.
Figure 2:
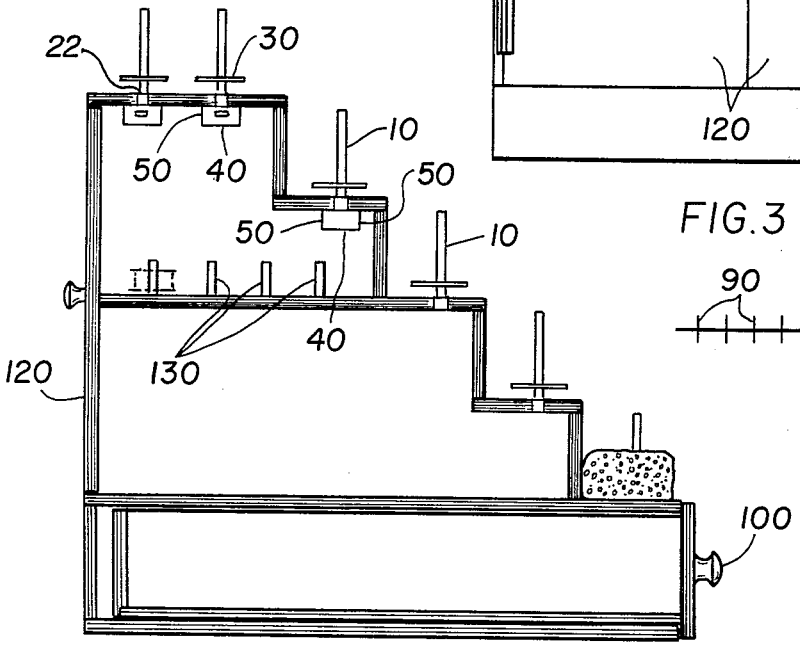
FIG. 2 is a view along line 2—2 in FIG. 1.
Figure 4:
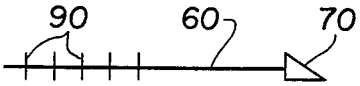
FIG. 4 is a drawing of a push rod used in the invention.

Referring now to FIGS. 1–4, a plurality of like, vertical cylindrical posts 10 are arranged in a plurality of straight tiers on top of a hollow base 20. The posts are individually slidable in corresponding holes 22 in the top of the base and are filled sufficiently tightly in the holes to remain fixed in any position after being pushed or pulled into this position.

A horizontal disc 30 larger than each hole is secured to each post and determines the normal position of minimum height for each post by acting as a stop. The disc also acts as a support for any spool disposed on the post.

Below the lower ends of the posts in any row, which are disposed below the surface of the base, is disposed a horizontal platform 40 supported by two like vertical rails 50. The rails are of such a thickness, that a space will exist between the platform and the lower ends of the posts even when the latter are in their normal state.

To raise a post, an elongated push rod 60 with a wedge-shaped head 70 at its forward end may be introduced into one of the rectangular cavities 80 in the side of the base, each of the cavities facing into the space between a platform and its supporting rails. By sliding the head of the push rod on top of the platform, the wedge will push up all the posts under which it passes. The rod is then pulled out to remove the wedge leaving all posts pushed up whereby the user can manually depress the posts which have been pushed up which are not to be left in their push up states. If desired, calibrations 90 can be painted on the push rod to show the user how far the push rod should be pushed in to raise a given post.

In use spools of thread 140 are disposed on the various posts. Different spools can then be selected for use as described.

As can be seen from the drawings, the base can contain one or more drawers 100 and can bear a pin cushion 110 on one of its step-like tiers. If desired, two rear doors 120 can enclose the space under the tiers. In this space may be disposed a plurality of fixed vertical posts 130 for the storage of bobbins and the like.

What is claimed is:

1. A device for holding spools of thread and the like, said device comprising:

a hollow base having holes in the top and having a side opening;

a plurality of like vertically elongated posts extending vertically upward from the top of the base and arranged in rows, said rows being arranged in a plurality of elongated tiers each post being disposed slidably in a corresponding one of the holes in the top of the base in a manner at which said each post can be pushed upwardly from a normal position of minimum elevation and can be returned to normal position;

a horizontal platform disposed within the base below the top thereof in a position at which said platform is spaced below the lower ends of the posts when said posts are in positions of minimum elevation, said platform being exposed through said side opening in the base;

a like plurality of horizontal discs, each disc being disposed on a corresponding one of said posts above the base to act both as a support for the spool and as a stop to determine the minimum elevation desired; and means cooperating with the base and posts to independently raise any one post or selected combination of posts in any given row to a level higher than any of the other posts in said given row, said means including an elongated push rod with a wedge shaped head at its forward end, said rod serving to push depressed posts upwardly when the wedge head is pushed through the opening and bears against the lower ends of posts to wedge the posts upwardly as its passes beneath them.

2. The device of claim 1 further including spools on the posts.

* * * * *